US009242824B2

(12) United States Patent
Arai et al.

(10) Patent No.: US 9,242,824 B2
(45) Date of Patent: Jan. 26, 2016

(54) TRANSPORT MECHANISM AND IMAGE FORMING APPARATUS

(71) Applicant: FUJI XEROX CO., LTD., Tokyo (JP)

(72) Inventors: Mizuki Arai, Kanagawa (JP); Naohito Otsuki, Kanagawa (JP); Kiyoshi Watanabe, Kanagawa (JP); Yoichi Yamakawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/277,357

(22) Filed: May 14, 2014

(65) Prior Publication Data

US 2015/0107966 A1 Apr. 23, 2015

(30) Foreign Application Priority Data

Oct. 22, 2013 (JP) ..... 2013-219410

(51) Int. Cl.
*B65H 9/00* (2006.01)

(52) U.S. Cl.
CPC ..... *B65H 9/002* (2013.01); *B65H 2404/50* (2013.01); *B65H 2511/11* (2013.01); *B65H 2701/11312* (2013.01)

(58) Field of Classification Search
CPC ..... B65H 9/002; B65H 2404/50; B65H 2511/11; B65H 2701/11312
See application file for complete search history.

(56) References Cited

U.S. PATENT DOCUMENTS

| | | | | |
|---|---|---|---|---|
| 6,168,153 | B1 * | 1/2001 | Richards et al. | 271/227 |
| 2008/0296828 | A1 * | 12/2008 | Shoji et al. | 271/10.12 |
| 2012/0251212 | A1 | 10/2012 | Hasegawa et al. | |

FOREIGN PATENT DOCUMENTS

| | | |
|---|---|---|
| JP | A-2012-188247 | 10/2012 |
| JP | A-2012-206791 | 10/2012 |

* cited by examiner

*Primary Examiner* — Michael McCullough
(74) *Attorney, Agent, or Firm* — Oliff PLC

(57) ABSTRACT

A transport mechanism includes a guide member that guides a transport object, which has a leading end and a trailing end, to be transported. The guide member includes a curved portion that is a curved portion of the guide member. The transport mechanism also includes a transport member that is disposed downstream of the curved portion in a transport direction in which the transport object is transported along the guide member, transports the transport object, and moves the transport object in an intersecting direction that intersects the transport direction. In the transport mechanism, when a length of the transport object in the transport direction is equal to or greater than a predetermined specified length that is greater than a distance between the transport member and the curved portion, the transport member does not move the transport object in the intersecting direction.

21 Claims, 6 Drawing Sheets

80
P
80
P
X
-X
Y
-Y
Z
-Z

TRANSPORT MECHANISM AND IMAGE FORMING APPARATUS

CROSS-REFERENCE TO RELATED APPLICATIONS

This application is based on and claims priority under 35 USC 119 from Japanese Patent Application No. 2013-219410 filed Oct. 22, 2013.

BACKGROUND

Technical Field

The present invention relates to a transport mechanism and an image forming apparatus.

SUMMARY

According to an aspect of the present invention, a transport mechanism includes a guide member that guides a transport object, which has a leading end and a trailing end, to be transported. The guide member includes a curved portion that is a curved portion of the guide member. The transport mechanism also includes a transport member that is disposed downstream of the curved portion in a transport direction in which the transport object is transported along the guide member, transports the transport object, and moves the transport object in an intersecting direction that intersects the transport direction. In the transport mechanism, when a length of the transport object in the transport direction is equal to or greater than a predetermined specified length that is greater than a distance between the transport member and the curved portion, the transport member does not move the transport object in the intersecting direction.

BRIEF DESCRIPTION OF THE DRAWINGS

Exemplary embodiment of the present invention will be described in detail based on the following figures, wherein.

DETAILED DESCRIPTION

An exemplary embodiment according to the present invention will be described below with reference to the drawings.

Configuration of Image Forming Apparatus 10

Figure 1:
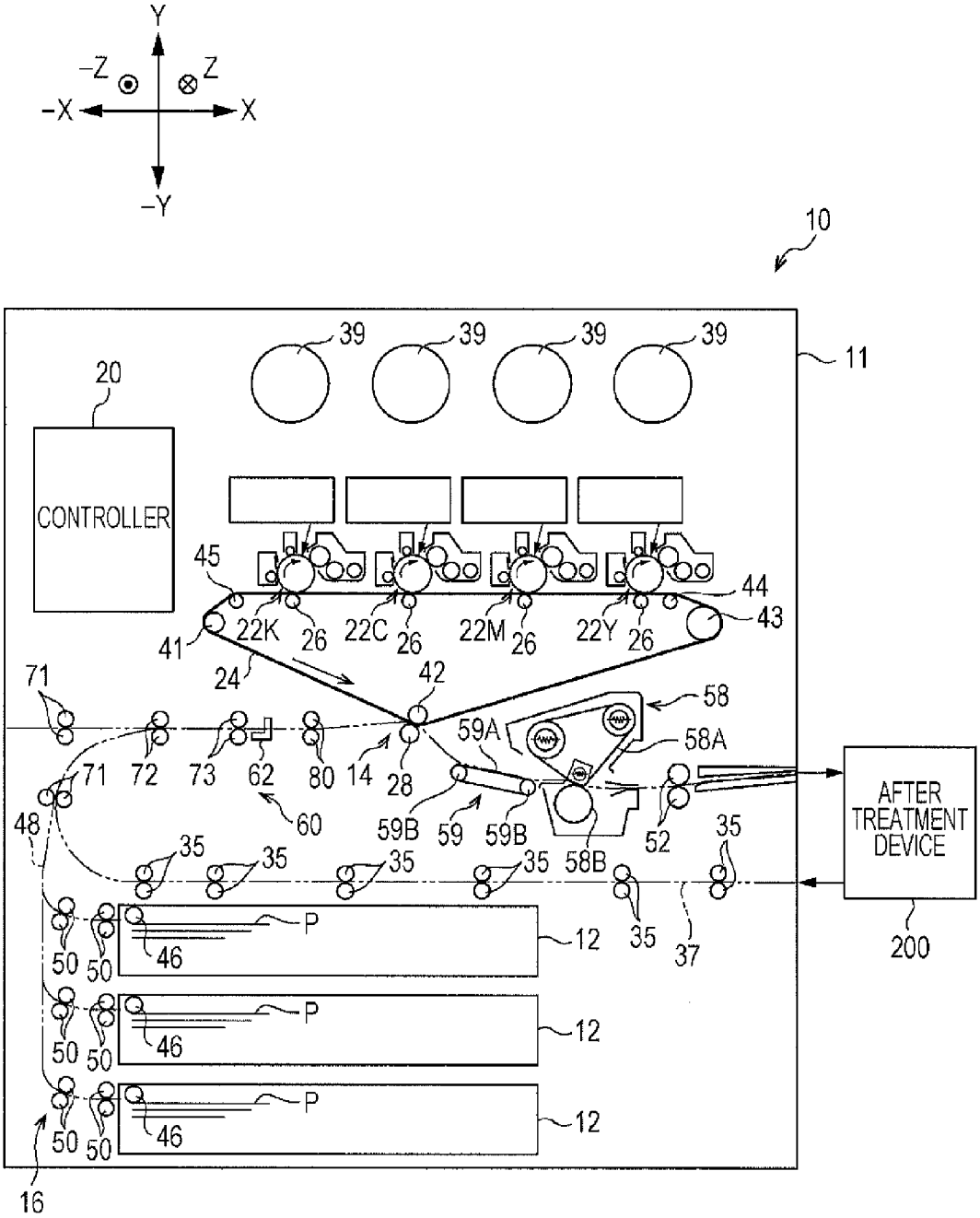
FIG. 1 is a schematic diagram of a configuration of an image forming apparatus according to an exemplary embodiment.

Initially, the configuration of an image forming apparatus 10 according to the present exemplary embodiment is described. FIG. 1 is a schematic diagram of the configuration of the image forming apparatus 10. The X, −X, Y (upper), −Y (lower), Z and −Z directions referred to in the following description are represented by the directions of arrows in the drawings. Also in the drawings, a circular symbol with an "x" therein indicates an arrow that extends from the front to the rear of the pages of the drawings, and a circular symbol with a dot therein indicates an arrow that extends from the rear to the front of the pages of the drawings.

As illustrated in FIG. 1, the image forming apparatus 10 includes an image forming apparatus body 11 (housing) in which components of the image forming apparatus 10 are housed. Plural sheet containers 12, an image forming section 14, a transport mechanism 16, and a controller 20 are disposed in the image forming apparatus body 11. Recording media P (each serving as an example of a transport object) such as sheets of paper are contained in the sheet containers 12. The image forming section 14 forms an image on the recording medium P. The transport mechanism 16 transports the recording media P from the sheet containers 12 to the image forming section 14. The controller 20 controls operations of the components of the image forming apparatus 10.

The image forming section 14 includes image forming units 22Y, 22M, 22C, and 22K (referred to as image forming units 22Y to 22K hereafter), an intermediate transfer belt 24, first transfer rollers 26, and a second transfer roller 28. The image forming units 22Y to 22K respectively form yellow (Y), magenta (M), cyan (C), and black (K) toner images. The toner images formed by the image forming units 22Y to 22K are transferred onto the intermediate transfer belt 24. The first transfer rollers 26 transfer the toner images formed by the image forming units 22Y to 22K onto the intermediate transfer belt 24. The second transfer roller 28 transfers the toner images, which have been transferred onto the intermediate transfer belt 24 by the first transfer rollers 26, from the intermediate transfer belt 24 onto the recording medium P. The configuration of the image forming section 14 is not limited to the above-described configuration. The image forming section 14 may use any configuration as long as an image is formed on the recording medium P with the configuration.

Figure 2:
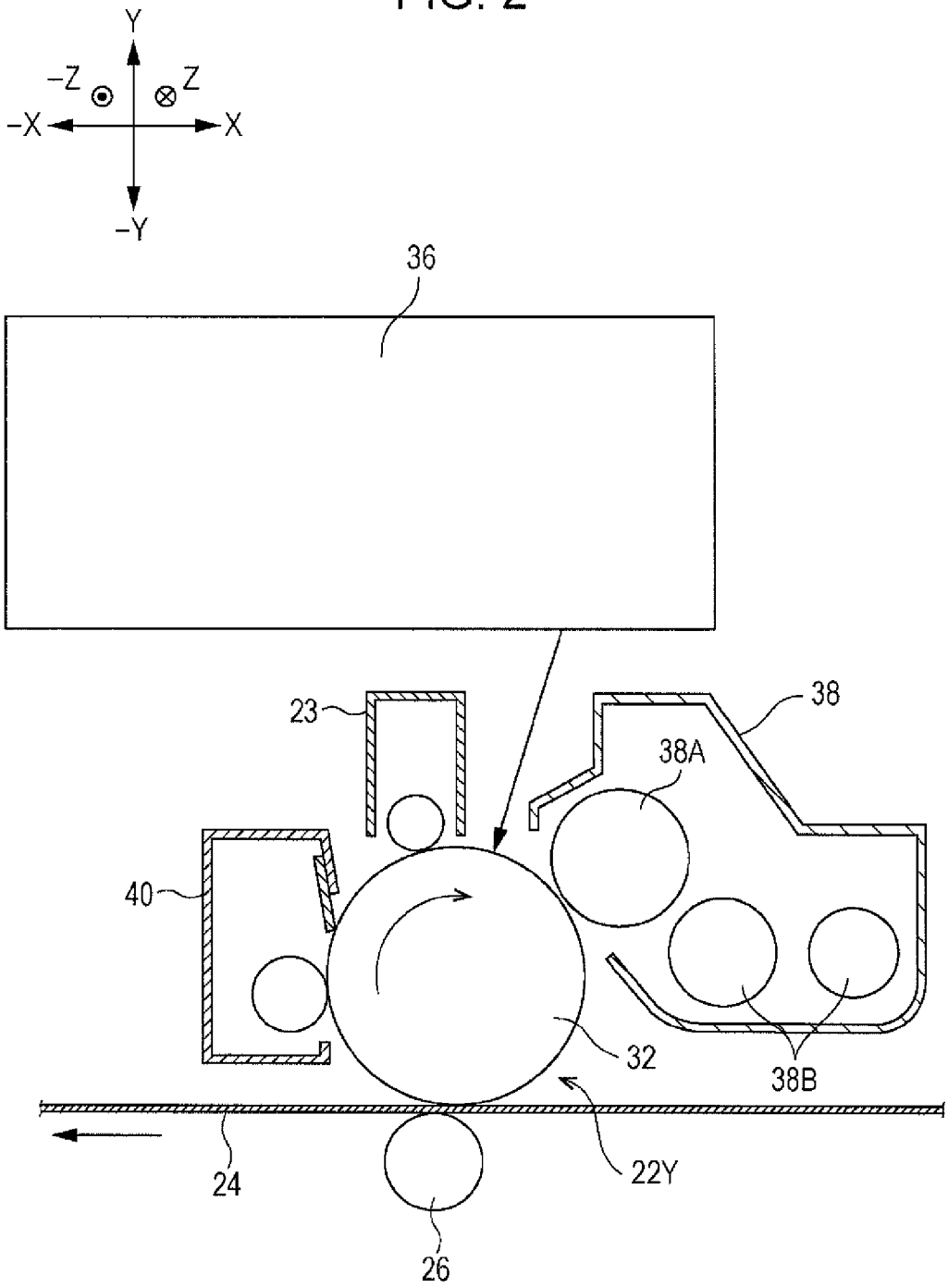
FIG. 2 is a schematic diagram of a configuration of an image forming unit according to the present exemplary embodiment.

The image forming units 22Y to 22K are arranged in the X direction on the Y direction side (upper side) of the intermediate transfer belt 24. As illustrated in FIG. 2, the image forming units 22Y to 22K each include a photoconductor body 32 rotatable in a single direction (for example, clockwise in FIG. 2). Since the image forming units 22Y to 22K are configured similarly to one another, the configuration of the image forming unit 22Y illustrated in FIG. 2 is representative of those of the image forming units 22Y to 22K.

A charger 23, an exposure device 36, a developing device 38, and a cleaning device 40 are provided around the photoconductor body 32 in order from the upstream side in the rotational direction of the photoconductor body 32. The charger 23 causes the photoconductor body 32 to be charged. The photoconductor body 32 having been charged by the charger 23 is exposed to light by the exposure device 36, thereby an electrostatic latent image is formed on the photoconductor body 32. The developing device 38 develops the electrostatic latent image formed on the photoconductor body 32 by using the exposure device 36, thereby forming a toner image. The cleaning device 40 is brought into contact with the photoconductor body 32 so as to remove toner remaining on the photoconductor body 32.

The exposure device 36 forms an electrostatic latent image in accordance with image signals transmitted from the controller 20 (see FIG. 1). Examples of the image signals transmitted from the controller 20 include, for example, an image signal obtained by the controller 20 from an external device.

The developing device 38 includes a developer supply body 38A and plural transport components 38B. The developer supply body 38A supplies developer to the photoconductor body 32. The transport components 38B transport developer to be fed to the developer supply body 38A while agitating the developer.

Referring back to FIG. 1, toner containers 39 are provided above the exposure devices 36. The toner containers 39 contain toner to be supplied to the developing devices 38 of the image forming units 22Y to 22K.

The intermediate transfer belt 24 has an annular shape and is disposed on the −Y side (lower side) of the image forming units 22Y to 22K. Stretching rollers 41, 42, 43, 44, and 45, over which the intermediate transfer belt 24 is stretched, are provided on an inner circumferential side of the intermediate transfer belt 24. The intermediate transfer belt 24 is moved in a circulating path (rotated) in a single direction (for example, counterclockwise direction in FIG. 1) by rotating, for example, the stretching roller 43 while being in contact with the photoconductor bodies 32. The stretching roller 42 serves as an opposing roller that opposes the second transfer roller 28.

Each of the first transfer rollers 26 opposes a corresponding one of the photoconductor bodies 32 with the intermediate transfer belt 24 nipped therebetween. A nip between the first transfer roller 26 and each of the photoconductor body 32 is defined as a first transfer position where a toner image formed on each of the photoconductor body 32 is transferred onto the intermediate transfer belt 24.

The second transfer roller 28 opposes the stretching roller 42 with the intermediate transfer belt 24 nipped therebetween. A nip between the second transfer roller 28 and the stretching roller 42 is defined as a second transfer position where toner images having been transferred onto the intermediate transfer belt 24 are transferred onto the recording medium P.

The transport mechanism 16 includes feeding rollers 46, a transport path 48, and plural transport rollers 50. The feeding rollers 46 feed the recording media P contained in the sheet containers 12. The recording media P fed by the feeding rollers 46 are transported through the transport path 48. The recording media P fed by the feeding rollers 46 are transported toward the second transfer position by the plural transport rollers 50 disposed along the transport path 48. The transport mechanism 16 also includes a skew correction mechanism 60 and registration roller pair 80. The skew correction mechanism 60 corrects skew of the recording medium P having been transported thereto by the transport rollers 50. The registration roller pair 80 (an example of a transport member) feeds the recording medium P, skew of which has been corrected, to the second transfer position.

The skew correction mechanism 60 includes an abutting member 62, a first transport roller pair 71, a second transport roller pair 72, and a third transport roller pair 73. A leading end of the recording medium P abuts the abutting member 62. The first to third transport roller pairs 71, 72, and 73 transport the recording medium P.

In the skew correction mechanism 60, while the rollers of the third transport roller pair 73 are separated from each other, the recording medium P is transported by at least one of the first transport roller pair 71 and the second transport roller pair 72, and the leading end of the recording medium P is caused to abut the abutting member 62 from one to the other side ends of the recording medium P so that skew of the recording medium P is corrected. Specific configurations of a transport path 37, the transport path 48, and the registration roller pair 80 will be described later.

A transport component 59 is provided downstream of the second transfer position in the transport direction. The transport component 59 transports the recording medium P, onto which the toner images have been transferred by the second transfer roller 28. The transport component 59 includes an annular (endless) transport belt 59A and a pair of rollers 59B, over which the transport belt 59A is stretched. By rotating at least one of the pair of rollers 59B while the recording medium P being held on an outer circumferential surface of the transport belt 59A, the recording medium P is transported to a fixing device 58, which will be described later. The recording medium P is, for example, sucked to the transport belt 59A by utilizing plural suction holes formed in the transport belt 59A, thereby the recording medium P is held on the transport belt 59A.

The fixing device 58 is provided downstream of the transport component 59 in the transport direction. The toner images having been transferred onto the recording medium P by the second transfer roller 28 are fixed onto the recording medium P by the fixing device 58. In the fixing device 58, the toner images are fixed onto the recording medium P, which has been transported from the transport component 59, by heat applied by a fixing belt 58A and pressure applied by a pressure roller 58B.

Ejection rollers 52 are provided downstream of the fixing device 58 in the transport direction. The recording medium P, onto which the toner images have been fixed, is ejected from the image forming apparatus body 11 to an after treatment device 200. The after treatment device 200 includes components such as, for example, a cooling unit (not shown), a correction unit (not shown), an inspection unit (not shown), and an output unit (not shown). The cooling unit cools the recording medium P. The correction unit corrects bending of the recording medium P. The inspection unit inspects an image formed on the recording medium P. The recording medium P is ejected to the output unit.

Furthermore, the transport path 37 is disposed at a position, which is below the fixing device 58 and above the sheet containers 12. The recording medium P, onto one side of which the toner images have been fixed, is returned to the second transfer position through the transport path 37. The recording medium P having been ejected to the after treatment device 200 by the ejection rollers 52 is inverted by the after treatment device 200 and fed to the transport path 37. The recording medium P having been fed to the transport path 37 is transported to the skew correction mechanism 60 by plural transport roller pairs 35 disposed along the transport path 37. Skew of the recording medium P having been transported to the skew correction mechanism 60 is corrected by the skew correction mechanism 60. Then, the recording medium P is fed to the second transfer position by the registration roller pair 80.

Image Forming Operation

Next, image forming operations performed by the image forming apparatus 10 according to the present exemplary embodiment are described. An image is formed on the recording medium P through the image forming operations.

In the image forming apparatus 10 according to the present exemplary embodiment, the recording media P having been fed from the sheet containers 12 by the feeding rollers 46 are transported by the plural transport rollers 50. Skew of each of the recording media P having been transported by the plural transport rollers 50 is corrected by the skew correction mechanism 60. Then, the recording medium P is fed to the second transfer position by the registration roller pair 80.

In each of the image forming units 22Y to 22K, the photoconductor body 32 charged by the charger 23 is exposed to light by the exposure device 36, thereby forming an electrostatic latent image on the photoconductor body 32. This electrostatic latent image is developed by the developing device 38, thereby a toner image is formed on the photoconductor body 32. The toner images of the colors formed by the image forming units 22Y to 22K are superposed with one another on the intermediate transfer belt 24 at the respective first transfer positions. Thus, a color image has been formed. The color image formed on the intermediate transfer belt 24 is transferred onto the recording medium P at the second transfer position.

The recording medium P, onto which the toner images have been transferred, is transported to the fixing device 58 by the transport component 59. The toner images having been transferred are fixed onto the recording medium P by the fixing device 58. The recording medium P, onto which the toner images have been fixed, is ejected from the image forming apparatus body 11 to the after treatment device 200 by the ejection rollers 52. Thus, a series of the image forming operations are performed.

Transport Path 48, 37

Figure 3:
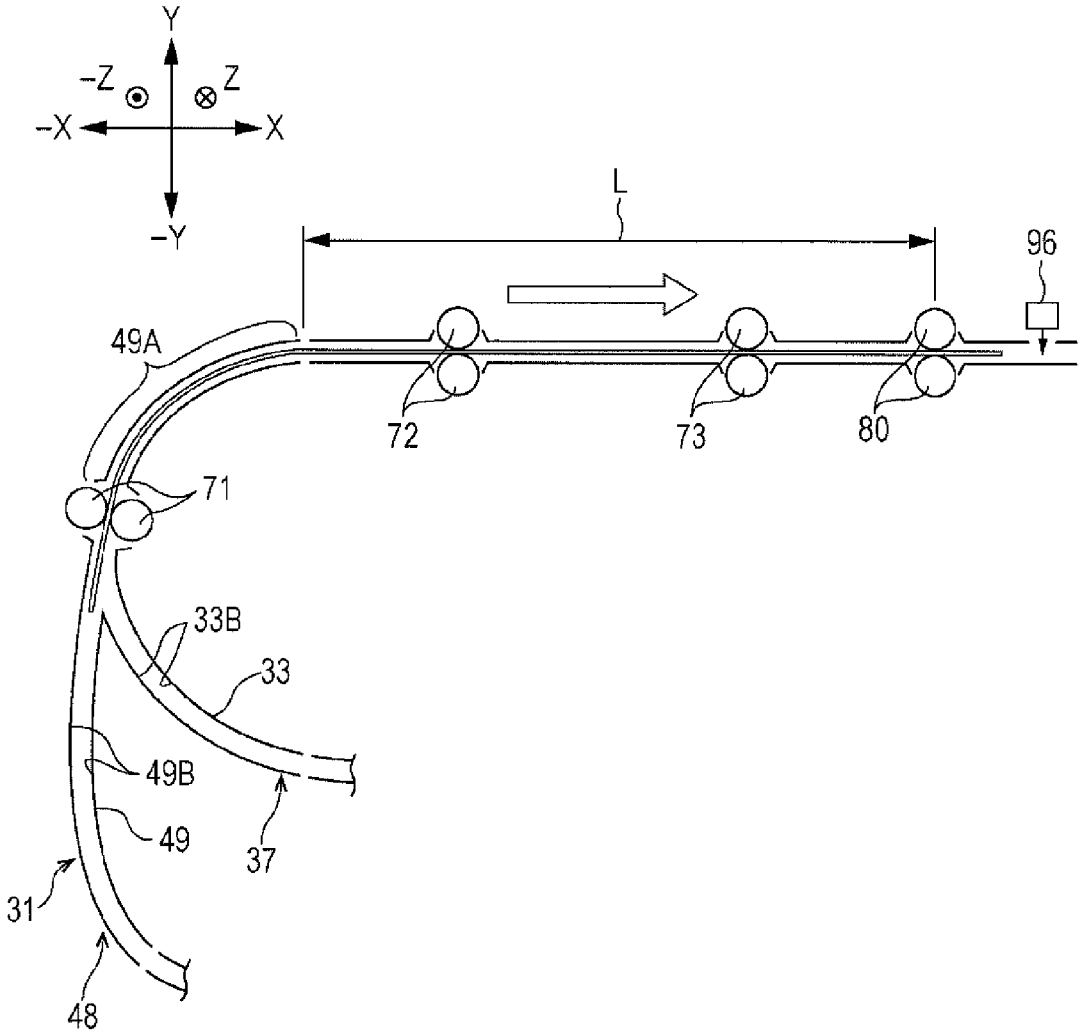
FIG. 3 is a schematic diagram of a configuration of a transport path according to the present exemplary embodiment.

As illustrated in FIG. 3, the transport path 48 has a curved portion 49 (chute member) that is curved so as to be convex toward the −X direction side. In the curved portion 49, the recording medium P being transported is guided toward the registration roller pair 80 through transport path surfaces 49B that are curved so as to be convex toward the −X direction side.

The transport path 37, through which the recording medium P is transported for duplex recording, has a curved portion 33 (chute member) connected to a middle portion of the curved portion 49. Transport path surfaces 33B of the curved portion 33 and transport path surfaces 49B of a downstream portion 49A of the curved portion 49 (a portion of the curved portion 49 downstream of a portion where the curved portion 33 is connected to the curved portion 49 in the transport direction) form transport path surfaces, which is curved to have an arc shape (semi-circle shape) so as to be convex toward the −X direction side. Through these transport path surfaces, the recording medium P transported from the transport path 37 is guided to the registration roller pair 80. In the present exemplary embodiment, a guide member 31 that guides the recording medium P includes the curved portion 33 and the curved portion 49. In the present exemplary embodiment, a guide member 31 that guides the recording medium P includes the curved portion 33, the curved portion 49, and a linear portion connected to the downstream side of the downstream portion 49A of the curved portion 49, and a connecting portion where the downstream portion 49A of the curved portion 49 is connected to the linear portion.

Registration Roller Pair 80

Figure 4:
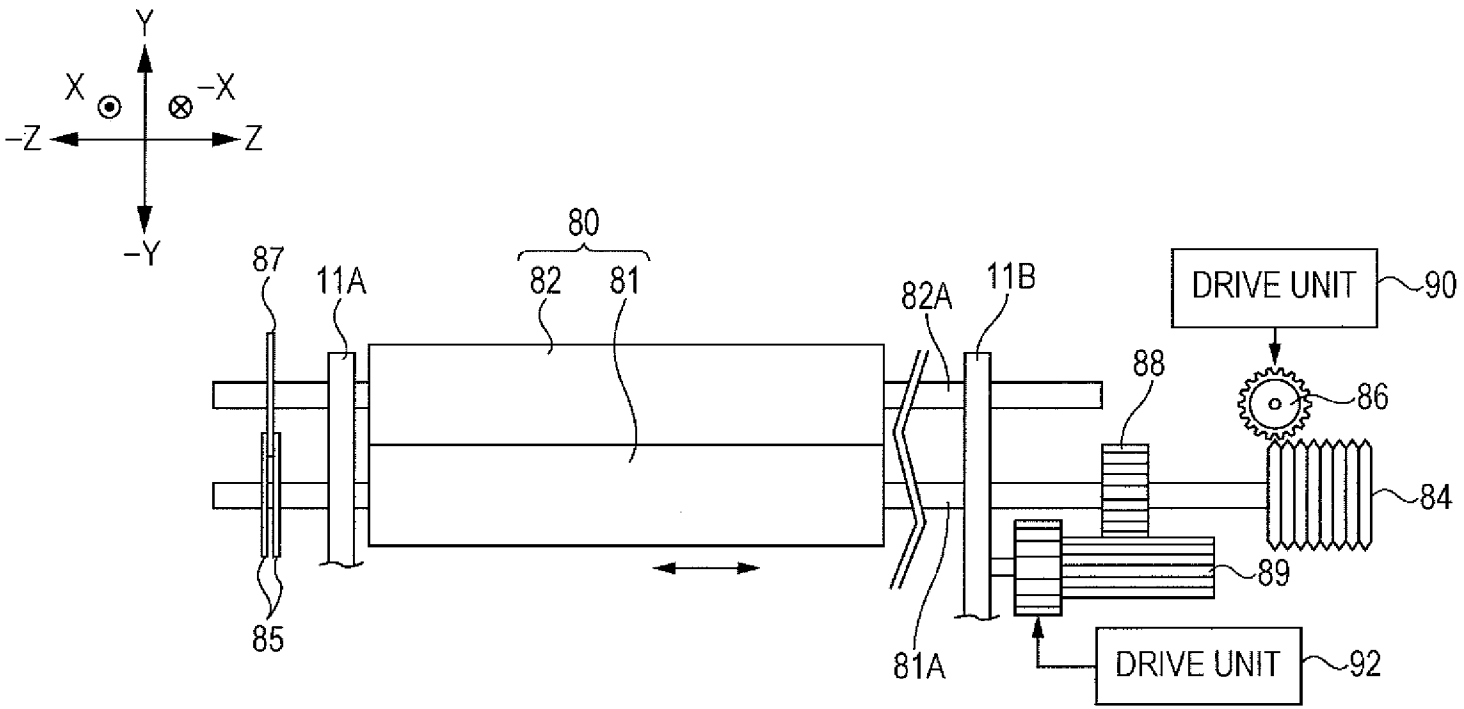
FIG. 4 is a schematic diagram of a configuration of a registration roller pair according to the present exemplary embodiment.

As illustrated in FIG. 4, the registration roller pair 80 (the example of the transport member) includes, for example, a drive roller 81 disposed on the −Y direction side (lower side) and a driven roller 82 disposed on the Y direction side (upper side).

The driven roller 82 includes a shaft portion 82A that extends in the Z direction. The shaft portion 82A is supported by frames 11A and 11B provided in the image forming apparatus body 11 (see FIG. 1) such that the shaft portion 82A is movable in the Z direction and rotatable relative to the frames 11A and 11B.

Similarly to the driven roller 82, the drive roller 81 includes a shaft portion 81A that extends in the Z direction. As is the case with the driven roller 82, the shaft portion 81A is supported by the frames 11A and 11B such that the shaft portion 81A is movable in the Z direction and rotatable relative to the frames 11A and 11B. A rack 84 is provided at one of end portions of the shaft portion 81A, the one end portion being at an end in the Z direction. The rack 84 has alternating projected and recessed portions in the Z direction, thereby teeth are formed. Each of the projected portions and each of the recessed portions are formed in the circumferential direction of the shaft portion 81A, and the positions of the teeth of the rack 84 in the Z direction are maintained even when the shaft portion 81A is rotated.

The rack 84 is engaged with a pinion 86. Thus, the rack 84 is moved in the Z direction by rotating the pinion 86. The pinion 86 is rotated by a drive force of a drive unit 90.

A driven gear 88 is secured to the shaft portion 81A at a position between the rack 84 and the frame 11B. The driven gear 88 is engaged with an intermediate gear 89 elongated in the Z direction. The intermediate gear 89 is rotated by a drive force of a drive unit 92. The length of the intermediate gear 89 in the Z direction is set in accordance with a movement amount of the drive roller 81 in the Z direction.

Two disc-shaped holding members 85 spaced apart from each other are secured to the shaft portion 81A on the −Z direction side of the frame 11A. A disc-shaped holding object member 87 is secured to the shaft portion 82A of the driven roller 82 on the −Z direction side of the frame 11A such that the holding object member 87 is held while being interposed between the two holding members 85. Thus, the driven roller 82 is moved along with the drive roller 81 in the Z direction.

In the registration roller pair 80, the drive force of the drive unit 92 is transmitted to the drive roller 81 via the intermediate gear 89 and the driven gear 88, thereby rotating the drive roller 81 clockwise in FIG. 3. The driven roller 82 is rotated counterclockwise in FIG. 3 by following the rotation of the drive roller 81. Also in the registration roller pair 80, forward rotation of the pinion 86 (clockwise rotation in FIG. 4) due to the drive force of the drive unit 90 causes the drive roller 81 to move to the −Z direction side through the rack 84. This also moves the driven roller 82 to the −Z direction side. In the registration roller pair 80, reverse rotation of the pinion 86 (counterclockwise rotation in FIG. 4) due to the drive force of the drive unit 90 causes the drive roller 81 to move to the Z direction side through the rack 84. This also moves the driven roller 82 to the Z direction side. Engagement of the driven gear 88 and the intermediate gear 89 is maintained within a movement range of the drive roller 81 moved to the Z and −Z direction sides.

In the registration roller pair 80, by rotating the drive roller 81 and the driven roller 82, the recording medium P is transported to the second transfer position at predetermined timing. Thus, transfer position (transfer start position) where the toner images is transferred from the intermediate transfer belt 24, is aligned with a transfer target position on the recording medium P.

Figures 5A, 5B:
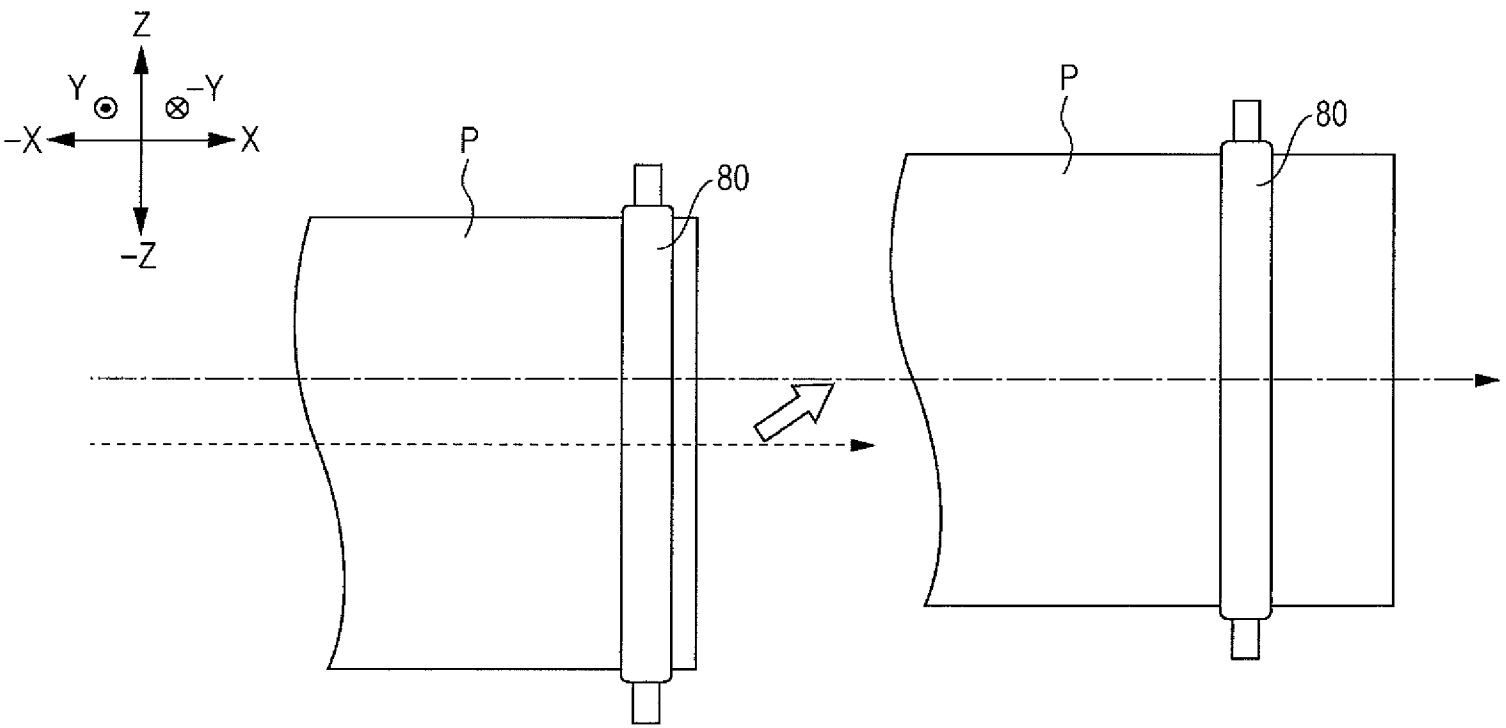
FIGS. 5A and 5B are schematic diagrams illustrating a correction operation in which a recording medium is moved in a Z direction.

Furthermore, in the registration roller pair 80, in addition to rotation of the drive roller 81 and the driven roller 82, the drive roller 81 and the driven roller 82 are moved in the axial direction. Thus, as illustrated in FIGS. 5A and 5B, shift of the recording medium P in the Z direction is corrected by the movement in the Z direction (intersecting direction), which is a direction intersecting the transport direction of the recording medium P, while the recording medium P is being transported. This correction operation is performed in a state where the abutting member 62 of the skew correction mechanism 60 is retracted from the transport path and the pair of rollers in each of the first to third transport roller pairs 71 to 73 are separate from each other (not nipping the recording medium P therebetween). FIG. 5A illustrates a state before the correction operation is performed, and FIG. 5B illustrates a state after the correction operation has been performed. The state illustrated in FIG. 5B is exaggerated.

The amount of the movement of the registration roller pair 80 in the axial direction is determined in accordance with a detection amount detected by a sensor 96 (see FIG. 3). As illustrated in FIG. 3, the sensor 96 is disposed downstream of the registration roller pair 80 in the transport direction. The sensor 96 detects the amount of shift of the recording medium P in a sheet width direction from a reference position. The sensor 96 detects, for example, when seen in the transport direction of the sheet, the amount of shift of the recording medium P to the right from the reference position as positive and the amount of shift of the recording medium P to the left from the reference position as negative. The sensor 96 uses a line sensor, in which photoelectric transducers are linearly arranged, or an image sensor, in which photoelectric transducers are arranged in a matrix.

Control Of Correction Operation Of Registration Roller Pair 80

In the present exemplary embodiment, whether or not the correction operation is performed by the registration roller pair 80 is controlled by the controller 20 as follows.

That is, in the present exemplary embodiment, the controller 20 causes the registration roller pair 80 to perform the correction operation, in which the recording medium P is moved in the Z direction, in the case where the length of the recording medium P in the transport direction is smaller than a predetermined specified length, which is greater than a distance L (see FIG. 3) between the registration roller pair 80 and the curved portion 49. The specified length is, for example, 488 mm.

The controller 20 causes the registration roller pair 80 not to perform the correction operation, in which the recording medium P is moved in the Z direction, in the case where the length of the recording medium P in the transport direction is equal to or greater than the specified length.

Specifically, specified length information of the predetermined specified length is stored (set) in the controller 20. Medium length information of the recording medium P having been input to the controller 20 is compared to the specified length information, and whether or not the correction operation is performed is determined in accordance with a result of the comparison. The Medium length information is obtained, for example, from an input operation, by reading (scanning) the recording medium P, or the like.

As described above, in the present exemplary embodiment, the correction operation is performed when the length of the recording medium P in the transport direction is smaller than the specified length and is not performed when the length of the recording medium P in the transport direction is equal to or greater than the specified length. Thus, the length of the recording medium P positioned on the curved portion 49 is greater when the correction operation is not performed than that when the correction operation is performed. That is, the correction operation is not performed when transport resistance generated by contact of a trailing end side of the recording medium P with the curved portion 49 is large.

Figure 6A:
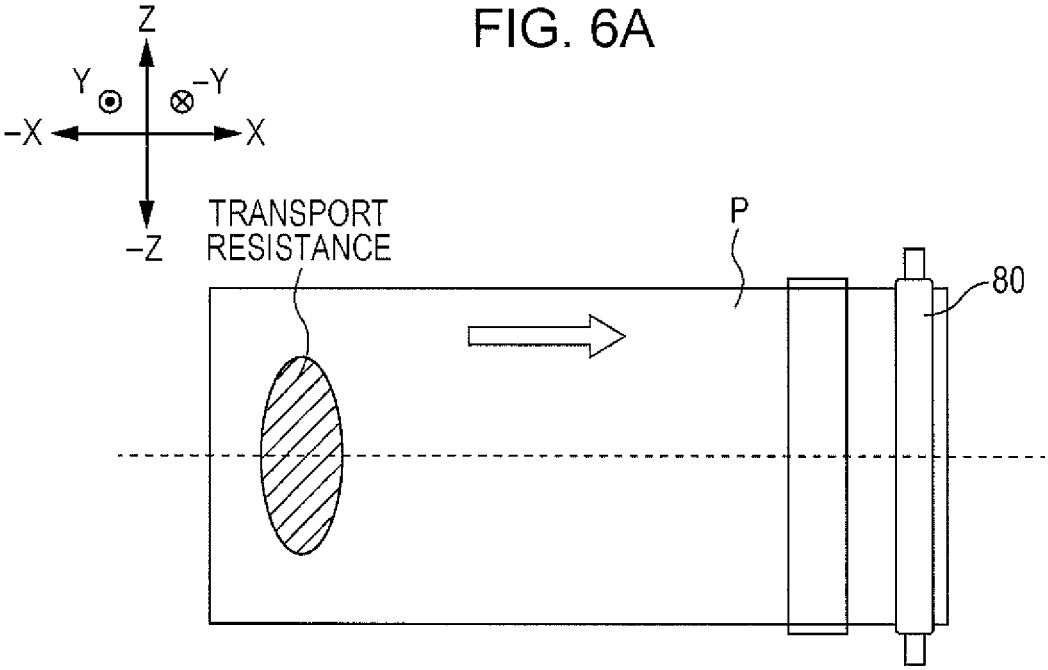
FIGS. 6A and 6B illustrate skew caused by the correction operation in which the recording medium is moved in the Z direction.
Figure 6B:
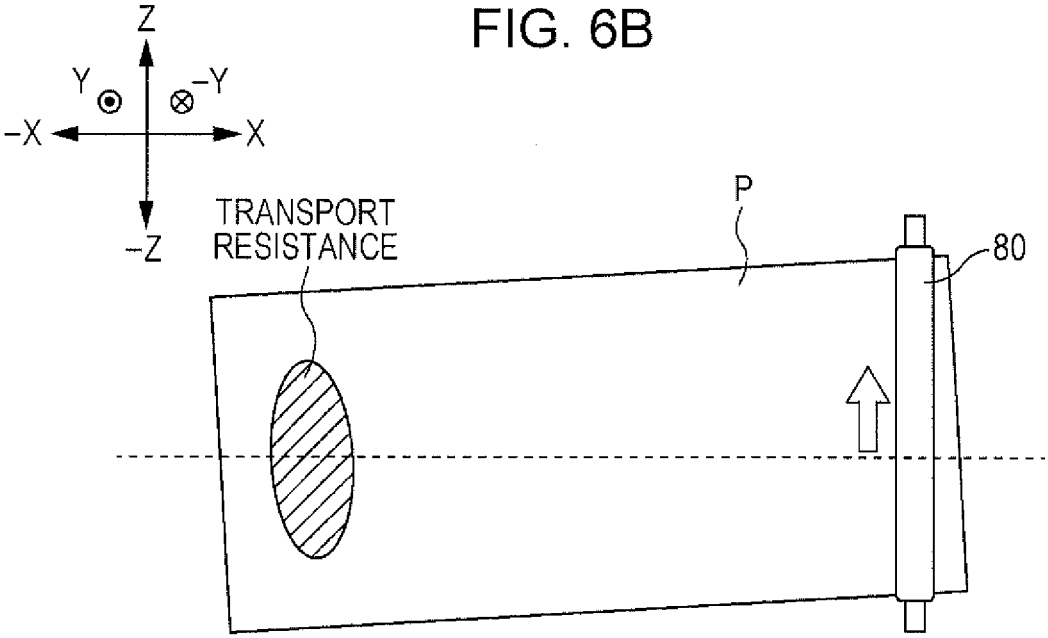

In the case of a comparative example, the correction operation is performed when transport resistance against the trailing end side of the recording medium P is large. In this case, as illustrated in FIG. 6B, when the leading end side of the recording medium P is moved in the Z direction by the registration roller pair 80, the trailing end side of the recording medium P does not follow the movement. This may cause the recording medium P to skew.

In contrast, in the present exemplary embodiment, the correction operation itself is not performed when transport resistance against the trailing end side of the recording medium P is large. Thus, as illustrated in FIG. 6A, skew of the recording medium P is suppressed.

when the length of the recording medium P in the transport direction is 488 mm, in a state in which the leading end of the recording medium P is nipped between the rollers of the registration roller pair 80, the recording medium P is disposed, for example, in the entirety of the path (about 180-degree range) formed by the curved portion 33 and the downstream portion 49A of the curved portion 49. That is, when the leading end of the recording medium P reaches the registration roller pair 80, the trailing end side of the recording medium P is disposed in the about 180-degree range of the path formed by the curved portion 33 and the downstream portion 49A of the curved portion 49. Here, the 180-degee range is a range from the connecting portion of the guide member 31 to a 180-degree position, which is a position where the curved portion 33 intersects a line that passes through the connecting portion and is perpendicular to the linear portion. The predetermined specified length is smaller than the distance between the registration roller pair 80 and this 180-degree position.

Furthermore, when the length of the recording medium P in the transport direction is 420 mm (A3-size), in a state in which the leading end of the recording medium P is nipped between the rollers of the registration roller pair 80, the recording medium P is disposed, for example, in an about 135-degree range of the path formed by the curved portion 33 and the downstream portion 49A of the curved portion 49. The trailing end side of the recording medium P, the length of which in the transport direction is about 140 mm (post card size), is not present in the curved portion 49.

When the correction operation is not performed by the registration roller pair 80, all or any one or two of the first transport roller pair 71, the second transport roller pair 72, and the third transport roller pair 73 may nip the recording medium P or may be in a separated state (not nipping the recording medium P).

In the present exemplary embodiment, shift in the Z direction is corrected by moving the recording medium P in the Z direction (intersecting direction), which intersects the transport direction of the recording medium P, by the registration roller pair 80 while the recording medium P is being transported in the X direction by the registration roller pair 80. However, shift correction is not limited to this. For example, the following correction is also possible: transportation of the recording medium P in the X direction by the registration roller pair 80 is stopped, the recording medium P is moved in the Z direction, and then, the recording medium P is transported again in the X direction.

The value of the specified length is not necessarily determined to be a single value. For example, the value of the specified length may be changed in accordance with the type of the recording medium P. Examples of the type of the recording medium P include the thickness (basis weight) of the recording medium P, the material of the recording medium P (for example, coated paper or not), and the stiffness of the recording medium P.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. For example, the plural foregoing variants may be appropriately combined. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport mechanism comprising:

a guide member that guides a transport object having a leading end and a trailing end to be transported, the guide member including a curved portion that is a curved portion of the guide member;

a transport member disposed downstream of the curved portion in a transport direction in which the transport object is transported along the guide member, the transport member transporting the transport object, and the transport member moving the transport object in an intersecting direction that intersects the transport direction, the transport member also moving in the intersecting direction; and a detecting member that detects a length of the transport object, wherein, when the length of the transport object in the transport direction is equal to or greater than a predetermined specified length that is greater than a distance between the transport member and the curved portion, the transport member does not move the transport object in the intersecting direction.

2. The transport mechanism according to claim 1, wherein the guide member includes a linear portion that has a linear shape and a connecting portion where the linear portion is connected to the curved portion, and wherein the predetermined specified length is smaller than a distance between the transport member and a position where the curve portion intersects a line that passes through the connecting portion and is perpendicular to the linear portion.

3. The transport mechanism according to claim 1, further comprising a control unit configured to determine a type of transport object to be transported, wherein a value of the specified length is changed in accordance with the determined type of the transport object to be transported, and wherein, when the length of the transport object in the transport direction is equal to or greater than the changed specified length value, the transport member does not move the transport object in the intersecting direction.

4. An image forming apparatus comprising:

the transport mechanism according to claim 1; and an image forming section that forms an image on a recording medium transported by the transport mechanism.

5. The transport mechanism according to claim 1, wherein the detecting member is a sensor.

6. The transport mechanism according to claim 1, wherein when the length of the transport object in the transport direction is less than the predetermined specified length, the transport member moves the transport object in the intersecting direction so as to perform a correction operation.

7. A transport mechanism comprising:

a guide member that guides a transport object having a leading end and a trailing end to be transported, the guide member including a curved portion that is a curved portion of the guide member; and a transport member disposed downstream of the curved portion in a transport direction in which the transport object is transported along the guide member, the transport member transporting the transport object, and the transport member moving the transport object in an intersecting direction that intersects the transport direction, the transport member also moving in the intersecting direction, wherein, when a length of the transport object in the transport direction is equal to or greater than a predetermined specified length that is greater than a distance between the transport member and the curved portion, the transport member does not move the transport object in the intersecting direction, and the length of the transport object is detected by a sensor.

8. The transport mechanism according to claim 7, wherein the guide member includes a linear portion that has a linear shape and a connecting portion where the linear portion is connected to the curved portion, and wherein the predetermined specified length is smaller than a distance between the transport member and a position where the curve portion intersects a line that passes through the connecting portion and is perpendicular to the linear portion.

9. The transport mechanism according to claim 7, further comprising a control unit configured to determine a type of transport object to be transported, wherein a value of the specified length is changed in accordance with the determined type of the transport object to be transported, and wherein, when the length of the transport object in the transport direction is equal to or greater than the changed specified length value, the transport member does not move the transport object in the intersecting direction.

10. An image forming apparatus comprising:

the transport mechanism according to claim 7; and an image forming section that forms an image on a recording medium transported by the transport mechanism.

11. The transport mechanism according to claim 7, wherein when the length of the transport object in the transport direction is less than the predetermined specified length, the transport member moves the transport object in the intersecting direction so as to perform a correction operation.

12. A transport mechanism comprising:

a guide member that guides a transport object having a leading end and a trailing end to be transported, the guide member including a curved portion that is a curved portion of the guide member;

a transport member disposed downstream of the curved portion in a transport direction in which the transport object is transported along the guide member, the transport member transporting the transport object, and the transport member moving the transport object in an intersecting direction that intersects the transport direction, the transport member also moving in the intersecting direction, wherein, when a length of the transport object in the transport direction is equal to or greater than a predetermined specified length that is greater than a distance between the transport member and the curved portion, the transport member does not move the transport object in the intersecting direction; and a control unit configured to determine a type of transport object to be transported, wherein a value of the specified length is changed in accordance with the determined type of the transport object to be transported, and wherein, when the length of the transport object in the transport direction is equal to or greater than the changed specified length value, the transport member does not move the transport object in the intersecting direction.

13. The transport mechanism according to claim 12, wherein the guide member includes a linear portion that has a linear shape and a connecting portion where the linear portion is connected to the curved portion, and wherein the predetermined specified length is smaller than a distance between the transport member and a position where the curve portion intersects a line that passes through the connecting portion and is perpendicular to the linear portion.

14. An image forming apparatus comprising:

the transport mechanism according to claim 12; and an image forming section that forms an image on a recording medium transported by the transport mechanism.

15. The transport mechanism according to claim 12, wherein when the length of the transport object in the transport direction is less than the predetermined specified length, the transport member moves the transport object in the intersecting direction so as to perform a correction operation.

16. A transport mechanism comprising:

a guide member that guides a transport object having a leading end and a trailing end to be transported, the guide member including a curved portion that is a curved portion of the guide member;

a transport member disposed downstream of the curved portion in a transport direction in which the transport object is transported along the guide member, the transport member transporting the transport object, and the transport member moving the transport object in an intersecting direction that intersects the transport direction, the transport member also moving in the intersecting direction; and a control unit configured to control operation of the transport member, wherein, when a length of the transport object in the transport direction is equal to or greater than a predetermined specified length that is greater than a distance between the transport member and the curved portion, the control unit controls the transport member such that the transport member does not move the transport object in the intersecting direction.

17. The transport mechanism according to claim 16, wherein the guide member includes a linear portion that has a linear shape and a connecting portion where the linear portion is connected to the curved portion, and wherein the predetermined specified length is smaller than a distance between the transport member and a position where the curved portion intersects a line that passes through the connecting portion and is perpendicular to the linear portion.

18. The transport mechanism according to claim 16, wherein the control unit is further configured to determine a type of transport object to be transported, wherein a value of the specified length is changed in accordance with the determined type of the transport object to be transported, and wherein, when the length of the transport object in the transport direction is equal to or greater than the changed specified length value, the control unit controls the transport member such that the transport member does not move the transport object in the intersecting direction.

19. An image forming apparatus comprising:

the transport mechanism according to claim 16; and an image forming section that forms an image on a recording medium transported by the transport mechanism.

20. The transport mechanism according to claim 16, wherein the length of the transport object is detected by a sensor.

21. The transport mechanism according to claim 16, wherein when the length of the transport object in the transport direction is less than the predetermined specified length, the control unit controls the transport member such that the transport member moves the transport object in the intersecting direction so as to perform a correction operation.

* * * * *